US005892334A

United States Patent [19]

Utzman

[11] Patent Number: 5,892,334

[45] Date of Patent: Apr. 6, 1999

[54] ADJUSTABLE TIMING LIGHT

[76] Inventor: Dennis J. Utzman, 15409 Dumont Ave., Norwalk, Calif. 90650

[21] Appl. No.: 950,147

[22] Filed: Oct. 14, 1997

[51] Int. Cl.[6] ..... H05B 37/00

[52] U.S. Cl. ..... 315/241 S; 315/77; 324/391; 362/372

[58] Field of Search ..... 315/241 S, 77, 315/58; 324/391, 393; 362/250, 251, 253, 372

[56] References Cited

U.S. PATENT DOCUMENTS

| | | | |
|---|---|---|---|
| D. 345,117 | 3/1994 | Pacetti et al. | D10/112 |
| 3,858,113 | 12/1974 | Pruss | 315/241 S X |
| 4,395,680 | 7/1983 | Slutzky | 315/241 S X |
| 4,423,624 | 1/1984 | Dooley et al. | 73/119 A |
| 4,594,886 | 6/1986 | Chen | 324/392 X |
| 4,692,668 | 9/1987 | Brown | 315/241 S |
| 4,713,617 | 12/1987 | Michalski | 324/395 |
| 5,023,764 | 6/1991 | McKinnon et al. | 362/299 |

*Primary Examiner*—Don Wong
*Assistant Examiner*—Halssa Philogene

[57] ABSTRACT

A adjustable timing light including a housing having bottom portion and a top portion. The top portion of the housing is pivotally coupled to the bottom portion of the housing such that the top portion has a first orientation situated perpendicularly with respect to the bottom portion and a second orientation positioned in coaxial relationship therewith. Also included is a light assembly positioned within an interior space of the top portion of the housing. The light assembly is adapted to emit light toward a top face of the top portion of the housing upon the receipt of power. A plurality of wires are in electrical communication with the light assembly and a coil and a spark plug of a vehicle.

6 Claims, 3 Drawing Sheets

ADJUSTABLE TIMING LIGHT

BACKGROUND OF THE INVENTION

1. Field of the Invention

The present invention relates to an adjustable timing light and more particularly pertains to allowing convenient use of a timing light.

2. Description of the Prior Art

The use of timing lights is known in the prior art. More specifically, timing lights heretofore devised and utilized for the purpose of adjusting the timing of a vehicle are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,713,617 to Michalski; U.S. Pat. No. 4,594,886 to Chen; U.S. Pat. Des. No. 345,117 Pacetti et al.; U.S. Pat. No. 4,423,624 to Dooley et al.; and U.S. Pat. No. 4,395,680 to Slutzky.

In this respect, the adjustable timing light according to the present invention substantially departs from the conventional concepts and designs of the prior art, and in so doing provides an apparatus primarily developed for the purpose of allowing convenient use of a timing light.

Therefore, it can be appreciated that there exists a continuing need for a new and improved adjustable timing light which can be used for allowing convenient use of a timing light. In this regard, the present invention substantially fulfills this need.

SUMMARY OF THE INVENTION

In view of the foregoing disadvantages inherent in the known types of timing lights now present in the prior art, the present invention provides an improved adjustable timing light. As such, the general purpose of the present invention, which will be described subsequently in greater detail, is to provide a new and improved adjustable timing light which has all the advantages of the prior art and none of the disadvantages.

To attain this, the present invention essentially comprises a housing having bottom portion with a cylindrical configuration. The bottom portion has a closed circular bottom face, a closed circular top face, and a periphery formed therebetween defining an interior space. As best shown in FIGS. 2 & 3, the top face has a thin generally rectangular tab coupled in perpendicular relationship with the top face and extended upwardly therefrom. The tab has an upper corner with a cut out formed therein. Note FIG. 3. The housing further includes a top portion also with a cylindrical configuration. The top portion has an open circular top face, an open circular bottom face, and a periphery formed therebetween defining an interior space. The top portion of the housing has a bottom corner with a cut out formed therein. By this structure, the top portion of the housing is pivotally coupled adjacent the bottom face thereof to the tab of the bottom portion of the housing. As such, the top portion has a first orientation situated perpendicularly with respect to the bottom portion and a second orientation positioned in coaxial relationship therewith. It should be noted that the top portion is adapted to pivot only within a single plane in which the bottom portion resides. With reference to FIG. 3 in particular, it is shown that a light assembly is positioned within the interior space of the top portion of the housing at a central extent thereof. In use, the light assembly is adapted to emit light toward the top face of the top portion of the housing upon the receipt of power. Associated therewith is a circular magnifying lens situated within the interior space of the top portion of the housing adjacent the top face thereof. The magnifying lens is designed to magnify the light emitted from the light assembly prior to exiting the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable timing light which has all the advantages of the prior art timing lights and none of the disadvantages.

It is another object of the present invention to provide a new and improved adjustable timing light which may be easily and efficiently manufactured and marketed.

It is a further object of the present invention to provide a new and improved adjustable timing light which is of a durable and reliable construction.

An even further object of the present invention is to provide a new and improved adjustable timing light which is susceptible of a low cost of manufacture with regard to both materials and labor, and which accordingly is then susceptible of low prices of sale to the consuming public, thereby making such adjustable timing light economically available to the buying public.

Still yet another object of the present invention is to provide a new and improved adjustable timing light which provides in the apparatuses and methods of the prior art some of the advantages thereof, while simultaneously overcoming some of the disadvantages normally associated therewith.

Still another object of the present invention is to allow convenient use of a timing light.

Lastly, it is an object of the present invention to provide a new and improved adjustable timing light including a housing having bottom portion and a top portion. The top portion of the housing is pivotally coupled to the bottom portion of the housing such that the top portion has a first orientation situated perpendicularly with respect to the bottom portion and a second orientation positioned in coaxial relationship therewith. Also included is a light assembly positioned within an interior space of the top portion of the housing. The light assembly is adapted to emit light toward a top face of the top portion of the housing upon the receipt of power. A plurality of wires are in electrical communication with the light assembly and a coil and a spark plug of a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
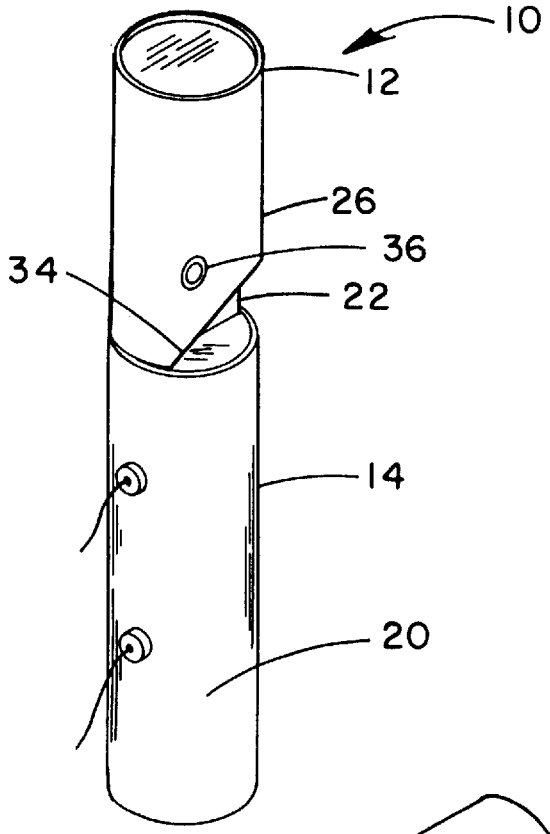
FIG. 1 is a perspective illustration of the preferred embodiment of the adjustable timing light constructed in accordance with the principles of the present invention.

With reference now to the drawings, and in particular to FIG. 1 thereof, a new and improved adjustable timing light embodying the principles and concepts of the present invention and generally designated by the reference numeral 10 will be described.

The present invention, the new and improved adjustable timing light, is comprised of a plurality of components. Such components in their broadest context include a housing, a light assembly, a magnifying lens, a set of wires, and a switch. Such components are individually configured and correlated with respect to each other so as to attain the desired objective.

Figure 2:
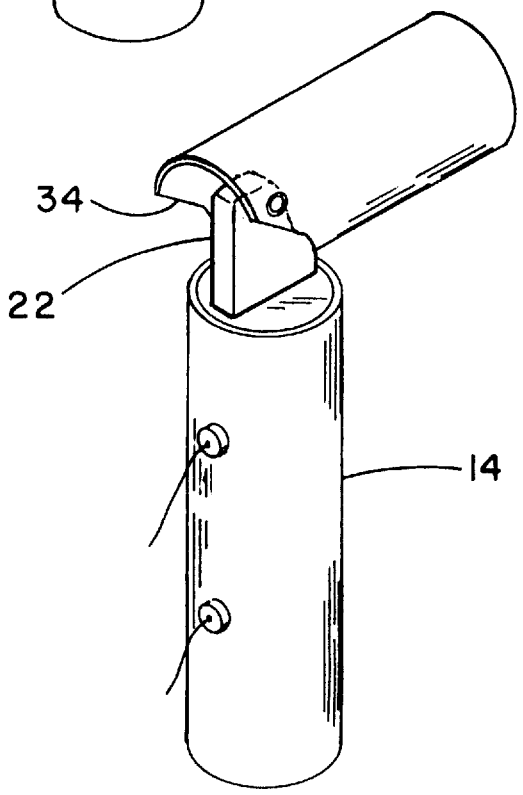
FIG. 2 is perspective view of the present invention with the top portion of thereof in the first orientation thereof.
Figures 3, 4, 6:
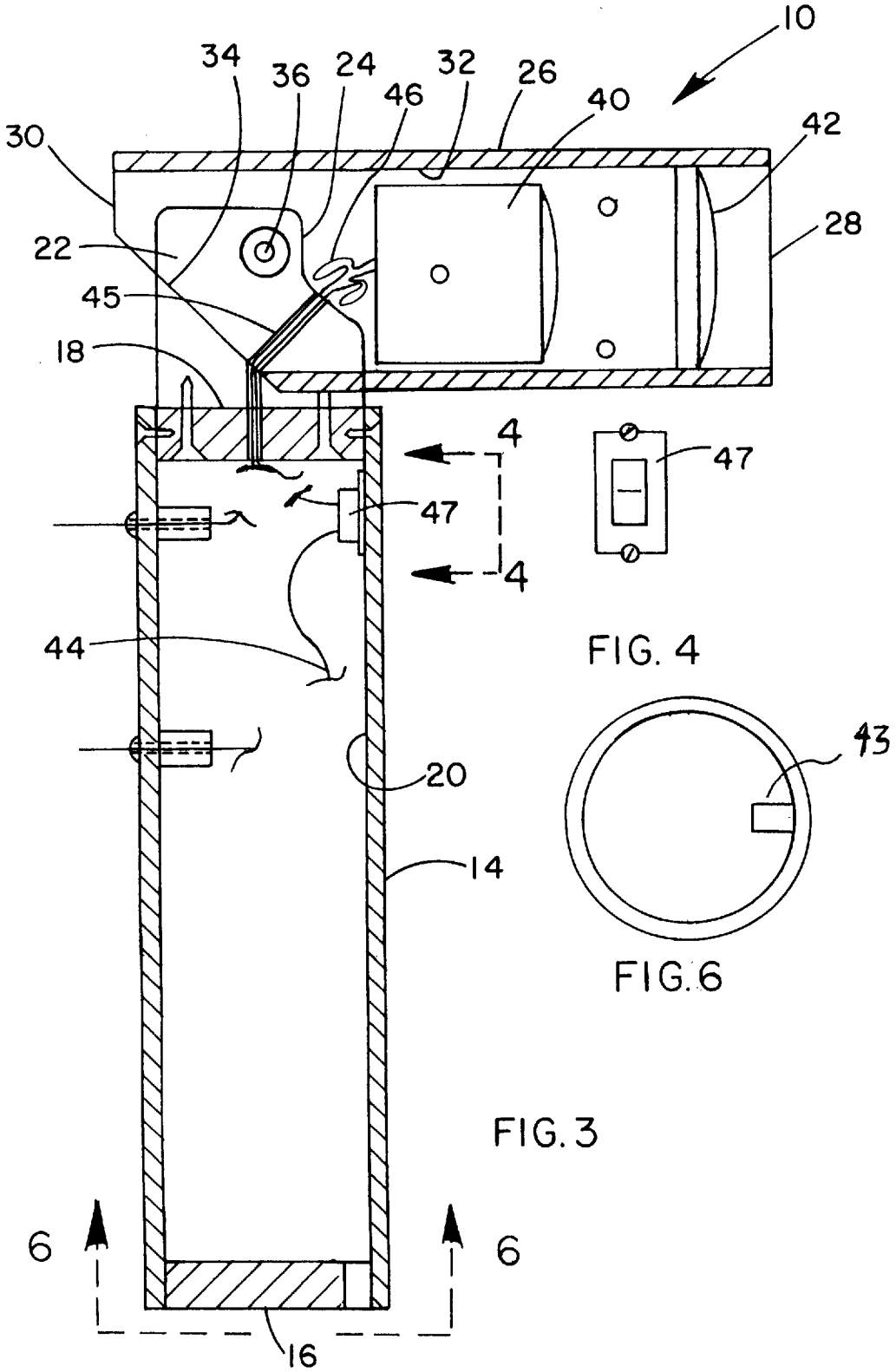
FIG. 3 is a cross-sectional view of the present invention taken along a vertical plane.
FIG. 4 is a front elevational view of the switch of the present invention.
FIG. 6 is a bottom view of the present invention.
Figure 5:
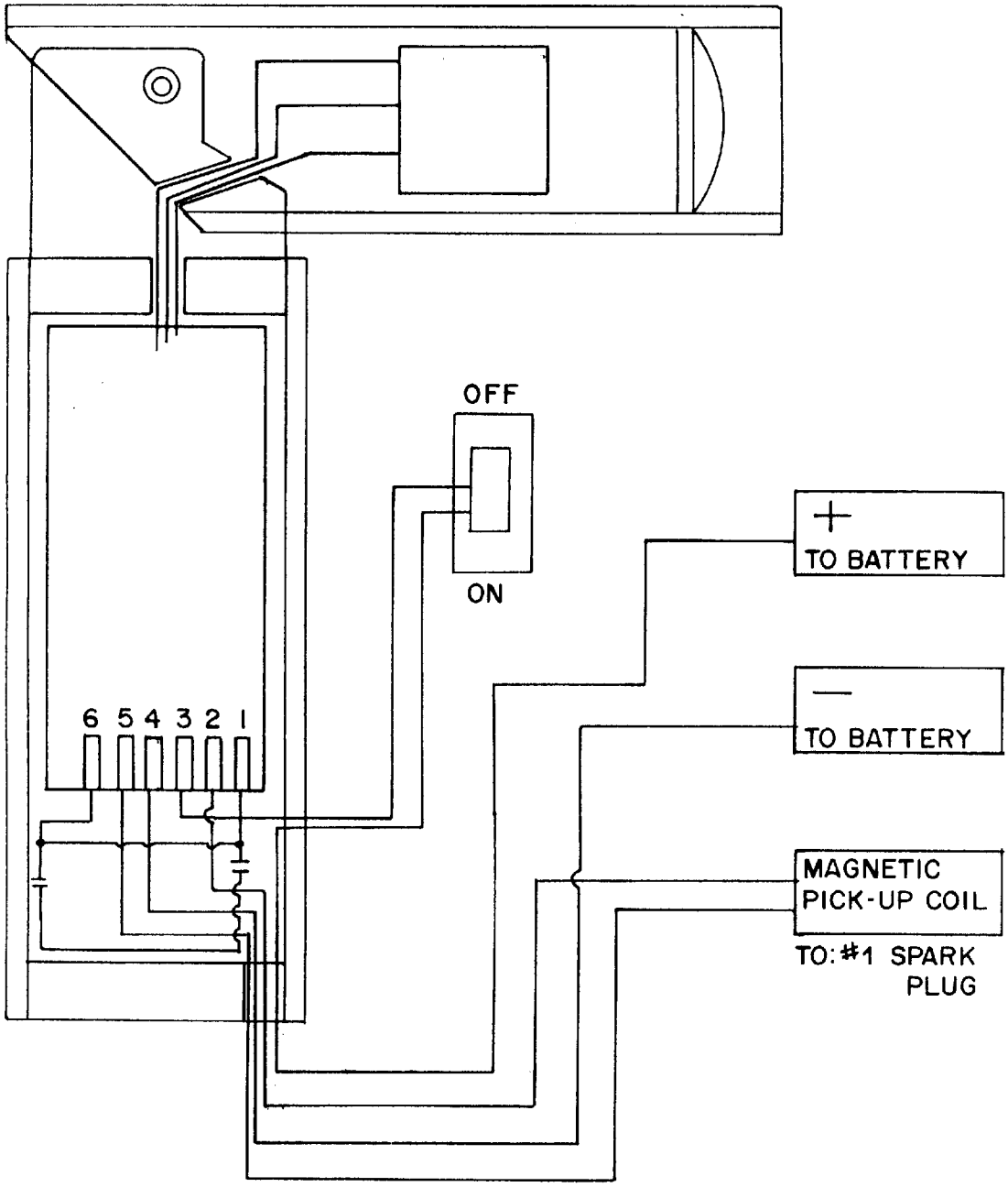
FIG. 5 is a diagram showing the interconnection of the timing light with the various components associated therewith.

More specifically, it will be noted that the system 10 of the present invention includes a housing 12 having bottom portion 14 with a cylindrical configuration. The bottom portion has a closed circular bottom face 16, a closed circular top face 18, and a periphery 20 formed therebetween defining an interior space. The bottom portion is preferably 7 inches in length and has a diameter of approximately 1 and ⅞ inches. As best shown in FIGS. 2 & 3, the top face has a thin generally rectangular tab 22 coupled in perpendicular relationship with the top face and extended upwardly therefrom. The tab has an upper corner with a generally triangular shaped cut out 24 formed therein. Note FIG. 3.

The housing further includes a top portion 26 also with a cylindrical configuration. The top portion has an open circular top face 28, an open circular bottom face 30, and a periphery 32 formed therebetween defining an interior space. In the preferred embodiment, the top portion has a length of approximately 5 and ⅛ inches and a diameter of about 1 and ⅞ inches. The top portion of the housing has a bottom corner with a cut out 34 formed therein. Such cutout defines a plane which extends between a central extent of the bottom face of the top portion to a point on the periphery a distance from the bottom face of about ¼ the total distance of the top portion.

By this structure, the top portion of the housing is pivotally coupled adjacent the bottom face thereof to the tab of the bottom portion of the housing. The coupling is preferably afforded by means of a pivot pin 36. As such, the top portion is adapted to pivot only between a first and second orientation. In the first orientation, the top portion is situated perpendicularly with respect to the bottom portion. Note FIG. 2. The top portion further has a second orientation positioned in coaxial relationship with the bottom portion, as shown in FIG. 1. It should be noted that the top portion is adapted to pivot only within a single plane in which the bottom portion resides. Further, when in the second orientation, the cut out of the top portion is aligned with that of the tab.

With reference to FIG. 3 in particular, it is shown that a light assembly 40 is positioned within the interior space of the top portion of the housing at a central extent thereof. In use, the light assembly is adapted to emit light toward the top face of the top portion of the housing upon the receipt of power.

Associated therewith is a circular magnifying lens 42 situated within the interior space of the top portion of the housing adjacent the top face thereof. The magnifying lens is designed to magnify the light emitted from the light assembly prior to it exiting the housing.

Further provided is a set of wires 44 including a first system of wires in electrical communication with the light assembly and a second system of wires extending from the periphery of the bottom portion of the housing. As shown in FIG. 3, the first system of wires extends within the interior space of the bottom portion of the housing and through a bore 45 formed in the tab and the top face of the bottom portion. Such bore, in turn, communicates with the interior space of the top portion of the housing. It should be noted that the bore includes a lower vertical extent and an upper bevelled extent that communicates with the cut out formed in the tab. As shown in FIG. 3, the first system of wires is equipped with slack 46 to allow proper pivoting of the top portion of the housing during use. The second system of wires is connected to an unillustrated coil and spark plug of a vehicle.

In an alternate embodiment, the second system of wires is situated through a bore 43 formed in the bottom face 16. Note FIG. 6. Also shown in FIG. 6 is the standard electrical interconnection of a circuit chip and the various electrical components of the present invention via the set of wires. Such interconnection serves to afford conventional electrical operation of the timing light.

Finally, a double-pole single throw switch 47 is provided to control the transfer of power to light assembly. Such switch is positioned on the periphery of the bottom portion of the housing opposite a point at which the second system of the wires leave the housing. The switch is electrically connected to the circuit chip for precluding the transfer of power to the light assembly in a first orientation. In a second orientation, the switch is adapted to allow the transfer of power to the light assembly.

The preset invention is a device that can easily be positioned between a motor and a body of a vehicle. It is much easier to use than Tee type timing lights, especially with front wheel drive vehicles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A adjustable timing light comprising, in combination:

a housing having bottom portion with a cylindrical configuration, the bottom portion having a closed circular bottom face, a closed circular top face, and a periphery formed therebetween defining an interior space, the top face having a thin generally rectangular tab coupled in perpendicular relationship with the top face and extended upwardly therefrom, the tab having an upper corner with a cut out formed therein, the housing further including a top portion with a cylindrical configuration, the top portion having an open circular top face, an open circular bottom face, and a periphery formed therebetween defining an interior space, the top portion of the housing having a bottom corner with a cut out formed therein, wherein the top portion of the housing is pivotally coupled adjacent the bottom face thereof to the tab of the bottom portion of the housing such that the top portion has a first orientation situated perpendicularly with respect to the bottom portion and a second orientation positioned in coaxial relationship therewith, the top portion adapted to pivot only within a single plane in which the bottom portion resides;

a light assembly positioned within the interior space of the top portion of the housing at a central extent thereof, the light assembly adapted to emit light toward the top face of the top portion of the housing upon the receipt of power;

a circular magnifying lens situated within the interior space of the top portion of the housing adjacent the top face thereof, the magnifying lens adapted to magnify the light emitted from the light assembly prior to exiting the housing;

a set of wires including a first system of wires in electrical communication with the light assembly and a second system of wires extending from the periphery of the bottom portion of the housing, wherein the first system of wires extend within the interior space of the bottom portion of the housing and through a bore formed in the tab which communicates with the interior space of the top portion of the housing, the second system of wires connected to a coil and a spark plug of a vehicle;

a double-pole single throw switch positioned on the periphery of the bottom portion of the housing, the switch in electric communication with the set of wires for precluding the transfer of power to the light assembly in a first orientation and further allowing the transfer of power to the light assembly in a second orientation;

whereby the light assembly may be utilized as a timing light.

2. A adjustable timing light comprising:

a housing having bottom portion and a top portion, the top portion of the housing pivotally coupled to the bottom portion of the housing such that the top portion has a first orientation situated perpendicularly with respect to the bottom portion and a second orientation positioned in coaxial relationship therewith;

a light assembly positioned within an interior space of the top portion of the housing, the light assembly adapted to emit light toward a top face of the top portion of the housing upon the receipt of power; and a plurality of wires in electrical communication with the light assembly and a coil and a spark plug of a vehicle;

whereby the light assembly is utilized as a timing light.

3. A adjustable timing light as set forth in claim 2 wherein the top portion is adapted to pivot only within a single plane in which the bottom portion resides.

4. A adjustable timing light as set forth in claim 2 wherein the top and bottom portions of the housing each have a cylindrical configuration.

5. A adjustable timing light as set forth in claim 2 and further including a circular magnifying lens situated within the top portion of the housing, the magnifying lens adapted to magnify the light emitted from the light assembly prior to it exiting the housing.

6. A adjustable timing light as set forth in claim 2 and further including a throw switch positioned on the housing for precluding the transfer of power to the light assembly in a first orientation and further allowing the transfer of power to the light assembly in a second orientation.

* * * * *